US011578687B1

(12) United States Patent
Reichardt et al.

(10) Patent No.: US 11,578,687 B1
(45) Date of Patent: Feb. 14, 2023

(54) MARINE ENGINE INTAKE MANIFOLDS HAVING NOISE ATTENUATION

(71) Applicant: Brunswick Corporation, Mettawa, IL (US)

(72) Inventors: Douglas D. Reichardt, West Bend, WI (US); Jong Hoe Huh, Fond du Lac, WI (US); Jeffrey Chiang, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/713,624

(22) Filed: Apr. 5, 2022

(51) Int. Cl.

| | |
|---|---|
| ***F02M 35/10*** | (2006.01) |
| ***F02M 35/12*** | (2006.01) |
| ***F02M 35/116*** | (2006.01) |
| ***F02B 27/02*** | (2006.01) |
| *F02B 75/18* | (2006.01) |

(52) U.S. Cl.
CPC ..... *F02M 35/116* (2013.01); *F02B 27/0252* (2013.01); *F02M 35/10072* (2013.01); *F02M 35/1233* (2013.01); *F02M 35/1255* (2013.01); *F02B 2075/1824* (2013.01)

(58) Field of Classification Search
CPC ..... F02B 27/0252; F02B 2075/1824; F02B 27/0247; F02M 35/116; F02M 35/10072; F02M 27/08; F02M 35/12; F02M 35/1211; F02M 35/1233; F02M 35/1255; F02M 35/1261; F02M 35/1266
See application file for complete search history.

(56) References Cited

U.S. PATENT DOCUMENTS

| | | | | |
|---|---|---|---|---|
| 3,920,095 | A * | 11/1975 | Clark | F16L 55/02 181/248 |
| 4,911,122 | A | 3/1990 | Corbett et al. | |
| 5,119,778 | A | 6/1992 | Corbett | |
| 5,735,229 | A | 4/1998 | House et al. | |
| 6,419,537 | B1 | 7/2002 | House et al. | |
| 6,526,933 | B2 | 3/2003 | Iizuka et al. | |
| 6,722,467 | B1 | 4/2004 | Kusche et al. | |
| 6,752,240 | B1 | 6/2004 | Schlagenhaft | |
| 6,830,024 | B2 | 12/2004 | Kodweiss et al. | |
| 6,899,579 | B1 | 5/2005 | Bruestle | |
| 7,198,017 | B2 | 4/2007 | Vogt et al. | |
| 7,497,196 | B2 | 3/2009 | Prior | |

(Continued)

FOREIGN PATENT DOCUMENTS

| | | |
|---|---|---|
| EP | 1284356 | 2/2003 |
| EP | 2009272 | 12/2008 |
| JP | 4960775 | 6/2012 |

*Primary Examiner* — Jacob M Amick
(74) *Attorney, Agent, or Firm* — Andrus Intellectual Property Law, LLP

(57) ABSTRACT

An intake manifold is for a marine engine having a throttle for controlling flow of intake air to the marine engine. The intake manifold has a plenum for receiving the intake air from the throttle, a plurality of intake runners which extends from upstream ends for receiving the intake air from the plenum to downstream ends for discharging the intake air to the marine engine, and a quarter wave resonator extending from an open end coupled to the plenum to a closed end, the quarter wave resonator having a tuned elongated cavity configured to attenuate sound emanating from the marine engine via the plurality of intake runners.

29 Claims, 10 Drawing Sheets

(56) References Cited

U.S. PATENT DOCUMENTS

| | | | |
|---|---|---|---|
| 7,556,010 | B2 | 7/2009 | Egawa et al. |
| 9,359,981 | B1 | 6/2016 | Waisanen et al. |
| 9,376,194 | B1 | 6/2016 | Jensen et al. |
| 9,376,195 | B1 | 6/2016 | Jaszewski et al. |
| 9,726,125 | B2 | 8/2017 | Arteaga et al. |
| 9,909,545 | B1 | 3/2018 | Waisanen et al. |
| 9,944,376 | B1 | 4/2018 | Waisanen et al. |
| 10,066,589 | B2 | 9/2018 | Chittoor et al. |
| 10,180,121 | B1 | 1/2019 | Waisanen et al. |
| 10,344,719 | B1 | 7/2019 | Wald et al. |
| 10,556,658 | B1 | 2/2020 | Frost et al. |
| 10,724,410 | B1 | 7/2020 | Waisanen |
| 10,760,539 | B2 | 9/2020 | Foreman |
| 10,947,939 | B1 | 3/2021 | Bandy |
| 10,995,648 | B1 | 5/2021 | Anderson, Jr. et al. |
| 2008/0072863 | A1* | 3/2008 | Egawa ..... F02M 35/10288 123/184.57 |

* cited by examiner

MARINE ENGINE INTAKE MANIFOLDS HAVING NOISE ATTENUATION

FIELD

The present disclosure relates to marine drives, and particularly to intake manifolds which provide noise attenuation for marine engines.

BACKGROUND

The following U.S. Patents are incorporated herein by reference in entirety.

U.S. Pat. No. 4,911,122 discloses a tuned combustion air intake system for a rotary engine including a plenum chamber mounted on the engine block and receiving cooling air discharged therefrom. Air from the plenum chamber is directed into an elongated outlet conduit of an extended length determined to provide an optimum pulsed air flow to the combustion air inlet to the carburetor. The extended length outlet conduit is wrapped at least partially around the plenum chamber to provide a compact construction particularly suitable to adapting the engine for use in an outboard motor. A supplemental air outlet from the plenum chamber to a downstream portion of the outlet conduit may be utilized to bypass a portion of the conduit to provide a change in the tuned length thereof for optimizing performance at difference engine speeds.

U.S. Pat. No. 5,119,778 discloses a tuned combustion air intake system for a rotary engine used in an outboard motor, including a plenum chamber mounted on the rear of the engine directly against the exhaust manifold. The plenum receives cooling air discharged from the engine. Air from the plenum chamber is directed into an elongated outlet conduit having an extended tuned length to provide an optimum pulsed air flow to the combustion air inlet of the engine. Direct attachment of the plenum chamber and integral outlet conduit to the rear of the engine eliminates extended length tubular connections of the prior art and allows the width of the engine to be kept to a minimum, thereby adapting the system to enclosure in a conventional cowl for an outboard motor.

U.S. Pat. No. 6,722,467 discloses a sound attenuation system for a compressor of a direct fuel injected engine of an outboard motor. The system comprises a discharge sound attenuator connected in fluid communication with an air distribution manifold outlet and a suction sound attenuator connected in fluid communication with the suction port of a compressor. In a typical application of the present invention, the air distribution manifold is connected in fluid communication with a discharge port of the compressor. Both the discharge sound attenuator and the suction sound attenuator can further include filter media disposed within their internal cavities.

U.S. Pat. No. 6,899,579 discloses an airflow control mechanism provided to control the flow of air through an opening formed in a portion of a cowl of an outboard motor. The airflow control mechanism is configured to be moveable between a first position and a second position to affect the magnitude of air flowing through an air passage defined as being the space between the opening formed in the cowl and an exit through which the air can leave the cavity of the cowl. The airflow control mechanism can control the flow of air as a function of an operating characteristic of the engine, such as its operating speed, the load on the engine, or the operating temperature of the engine.

U.S. Pat. No. 9,909,545 discloses an outboard motor including an internal combustion engine powering the outboard motor and a cowl covering the engine and having a vent allowing air under the cowl. A throttle body meters flow of the air into the engine and an intake structure downstream of the throttle body delivers the metered airflow to one or more combustion chambers in a cylinder block of the engine. A sound enhancement assembly in acoustic communication with the intake structure collects sounds emitted by the engine. The sound enhancement assembly is configured to amplify a subset of the collected sounds that have frequencies within a desired frequency range. A method for modifying sounds produced by an air intake system of an internal combustion engine powering an outboard motor is also disclosed. The method includes positioning a sound enhancement assembly in acoustic communication with an air intake passageway located downstream of the engine's throttle body.

U.S. Pat. No. 10,180,121 discloses an outboard motor including an internal combustion engine and a cowl covering the engine. An air vent allows intake air into the cowl, an air intake duct routes the intake air from the air vent to the engine, and a throttle body meters flow of the intake air from the air intake duct into the engine. A sound enhancement device is located proximate the throttle body. A sound duct is provided, and has an inlet end located proximate the sound enhancement device and an outlet end located proximate an outer surface of the cowl. The sound enhancement device is tuned to amplify a first subset of sounds having a desired frequency that are emitted from the throttle body, and the sound duct transmits the amplified sounds to an area outside the cowl. A method for modifying sounds produced by an air intake system of an outboard motor is also provided.

U.S. Pat. No. 10,344,719 discloses an intake system for a marine drive. The intake system comprises a throttle device that receives intake air for combustion; an intake conduit that conveys the intake air to the throttle device, wherein the intake conduit has an upstream inlet end, a downstream outlet end, and a radially outer surface that extends from the upstream inlet end to the downstream outlet end; and an intake silencer coupled to the radially outer surface and configured to attenuate sound emanating from the intake system.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

In non-limiting examples disclosed herein, an intake manifold is for a marine engine having a throttle for controlling flow of intake air to the marine engine. The intake manifold comprises a plenum for receiving the intake air from the throttle, a plurality of intake runners which extends from upstream ends receiving the intake air from the plenum to downstream ends for discharging the intake air to the marine engine, and a quarter wave resonator having an elongated cavity extending from an open end coupled to the plenum to a closed end, the elongated cavity being tuned to attenuate sound emanating from the marine engine via the plurality of intake runners.

In non-limiting examples, the quarter wave resonator extends parallel to and adjacent to the intake runners, including for example wherein the intake runners are aligned in a stack and wherein the quarter wave resonator is on top of the stack.

In non-limiting examples, the open end of the quarter wave resonator is exposed to the plenum and also exposed to the upstream ends of the intake plenum. The upstream ends of the plurality of intake runners has a stepped formation relative to the plenum, wherein the stepped formation steps away from the open end of the quarter wave resonator. Each intake runner may be equal in length.

In non-limiting examples, the intake manifold comprises a monolithic inner manifold half and a monolithic outer manifold half which are mated together to define the plurality of intake runners, the plenum, and the quarter wave resonator. The quarter wave resonator comprises an elongated body extending alongside the plurality of intake runners and an elbow portion which couples the elongated body to the plenum. A sensor is coupled to the elbow portion and exposed to the plenum via the open end of the elongated cavity, the sensor being configured to sense temperature and pressure of the intake manifold.

In non-limiting examples, an intake manifold is for a marine engine having a throttle for controlling flow of intake air to the marine engine. The intake manifold extends in a length direction, a width direction which is perpendicular to the length direction, and a height direction that is perpendicular to the length direction and perpendicular to the width direction. The intake manifold comprises a plurality of intake runners which longitudinally extends from upstream ends for receiving the intake air to downstream ends for discharging the intake air to the marine engine, a plenum for receiving the intake air from the throttle and discharging the intake air to the upstream ends of the plurality of intake runners, and a quarter wave resonator extending from an open end coupled to the plenum to a closed end, the quarter wave resonator longitudinally extending alongside the plurality of intake runners and having a tuned elongated cavity configured to attenuate sound emanating from the marine engine via the plurality of intake runners.

In non-limiting examples, a marine engine comprises an engine block having a plurality of cylinders for combustion, wherein the engine block extends in a length direction, in a width direction which is perpendicular to the length direction, and in a height direction that is perpendicular to the length direction and perpendicular to the width direction. A throttle is for controlling flow of intake air to the engine block. An intake manifold comprises a plenum for receiving the intake air from the throttle and a plurality of intake runners which longitudinally extends from upstream ends receiving the intake air from the plenum to downstream ends discharging the intake air to the plurality of cylinders. A quarter wave resonator extends from an open end coupled to the plenum to a closed end, the quarter wave resonator longitudinally extending alongside the plurality of intake runners and having an elongated cavity which is tuned to attenuate sound emanating from the marine engine via the plurality of intake runners.

BRIEF DESCRIPTION OF THE DRAWINGS

The present disclosure includes the following Figures.

DETAILED DESCRIPTION

Figure 1:
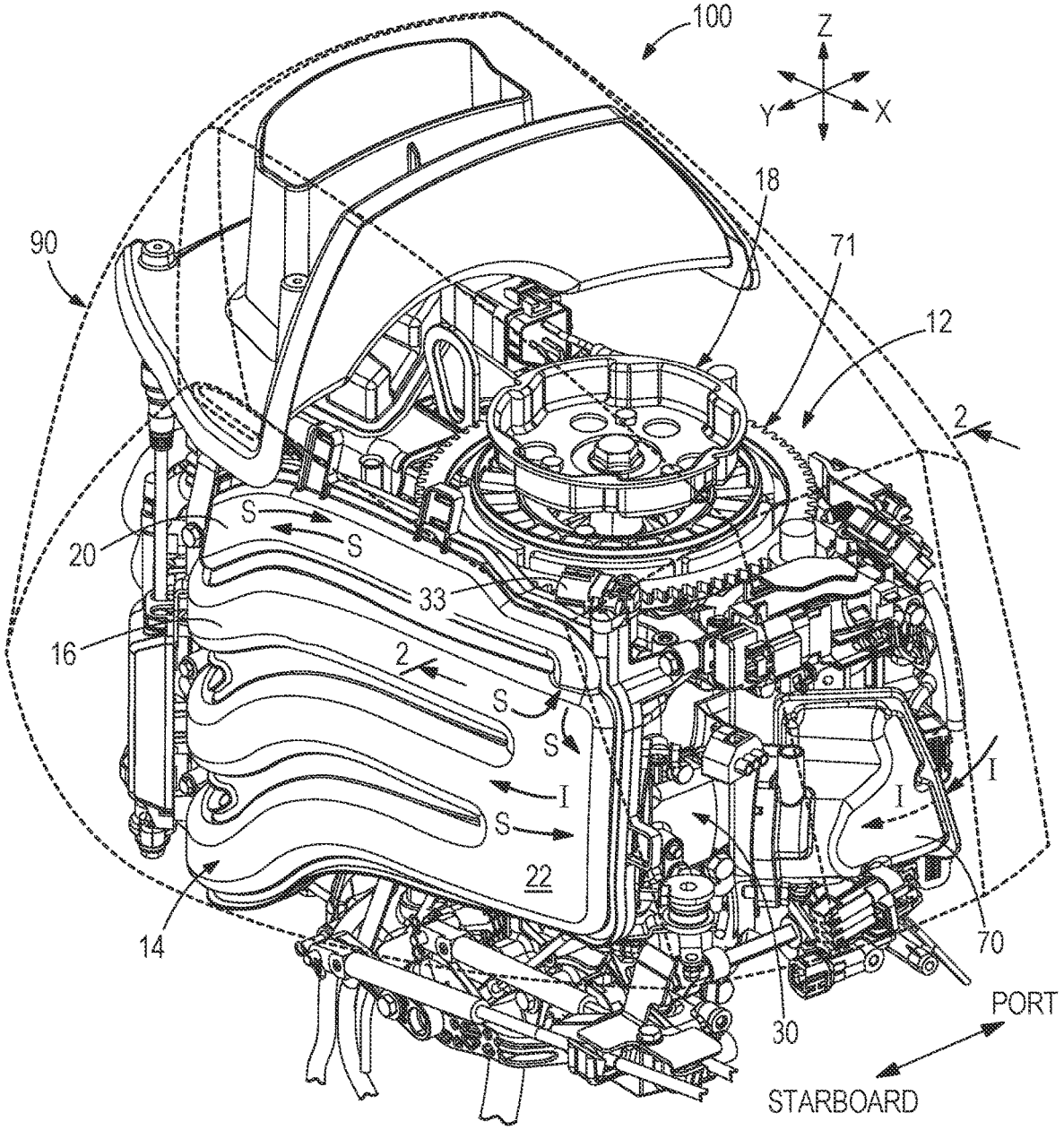
FIG. 1 is a perspective view of a marine drive having an intake manifold configured to provide noise attenuation according to the present disclosure.
Figure 2:
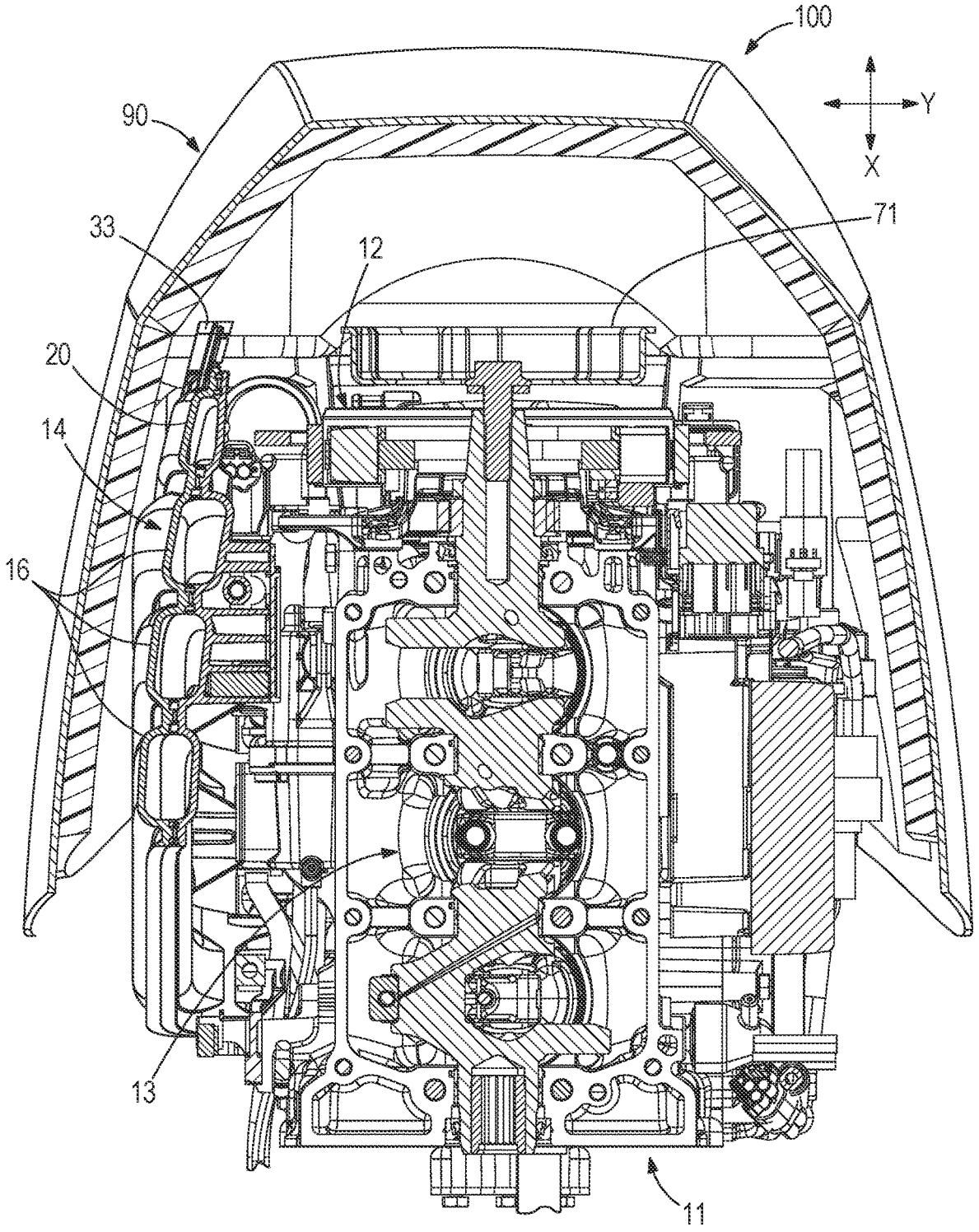
FIG. 2 is a view of Section 2-2, taken in FIG. 1.

FIGS. 1-2 illustrate an outboard motor 100 for propelling a marine vessel (not shown) in water. In the illustrated example, the marine drive is an outboard motor 100. Only portions of the outboard motor 100 are shown, including a top cowling 90 and an internal combustion engine 12 covered by the top cowling 90. The remainder of the outboard motor 100 may be conventional and for example can be configured like one or more of the examples disclosed in the above-incorporated U.S. Patents. The outboard motor 100 is merely exemplary and the present disclosure is applicable to other types of outboard motors. The present disclosure is also applicable to any other type of marine drives having one or more intake runners such as but not limited to stern drives, pod drives, V-drives, straight shaft drives, Arneson surface drives, and the like.

In the illustrated example, the outboard motor 100 includes the internal combustion engine 12 having a conventional engine block 71. The engine block 71 has three cylinders 13, each of which receives intake air for the combustion process via an intake manifold 14. The number of cylinders 13 shown in the drawings is not limiting and concepts of the present disclosure are applicable to engines having other numbers of cylinders. The outboard motor 100 also has a conventional throttle 30 for controlling flow of intake air to the engine 12. The type and configuration of the throttle 30 can vary. The throttle 30 may be a conventional device for controlling flow of intake air to the engine 12. The throttle 30 has throttle body and an intake inlet 70 facing a port-side of the marine vessel for drawing intake air into the intake manifold 14. The intake inlet 70 may further include a screen for preventing intake of debris into the intake manifold 14. For brevity, the throttle 30 is not further detailed herein.

The intake manifold 14 and engine 12 extend in three dimensions, namely from front to back in a length direction X (longitudinally), from side to side in a width direction Y (laterally) which is perpendicular to the length direction X, and from top to bottom in a height direction Z (vertically) which is perpendicular to the length direction X and the width direction Y. The intake manifold 14 is laterally disposed alongside a starboard-side of the engine 12 between an interior surface of the cowling 90 and the engine 12. Vertically, the manifold 14 is configured to fit below a flywheel 18 of the engine 12. Furthermore, the manifold 14 is located downstream of the throttle 30, such that intake air travels generally in the direction indicated by arrows I and sound travels generally in the direction indicated by arrows S.

During research and development, the present inventors recognized a need in the art for an improved air intake manifold for a marine engine, and in non-limiting examples of a three-cylinder engine having a most prominent third-order firing frequency and running at a speed of above 5900

RPM or about 6000 RPM. The inventors endeavored to invent such an intake manifold for use within a relatively small cowling, in adherence with space constraints, and without interfering with other engine components. The present disclosure provides examples of various novel concepts which resulted from these endeavors.

Figure 3:
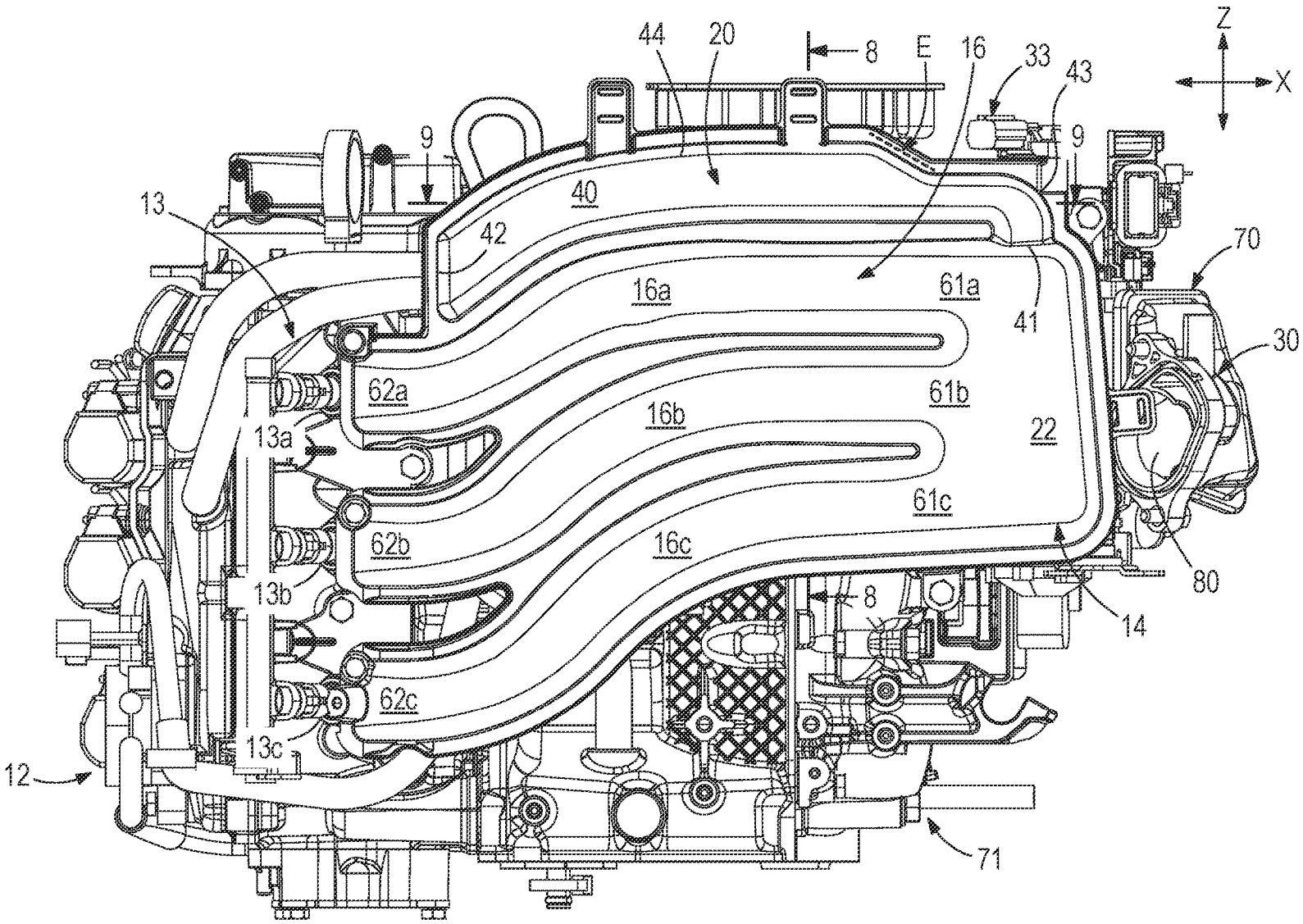
FIG. 3 is a side view of the marine drive and intake manifold.
Figure 4:
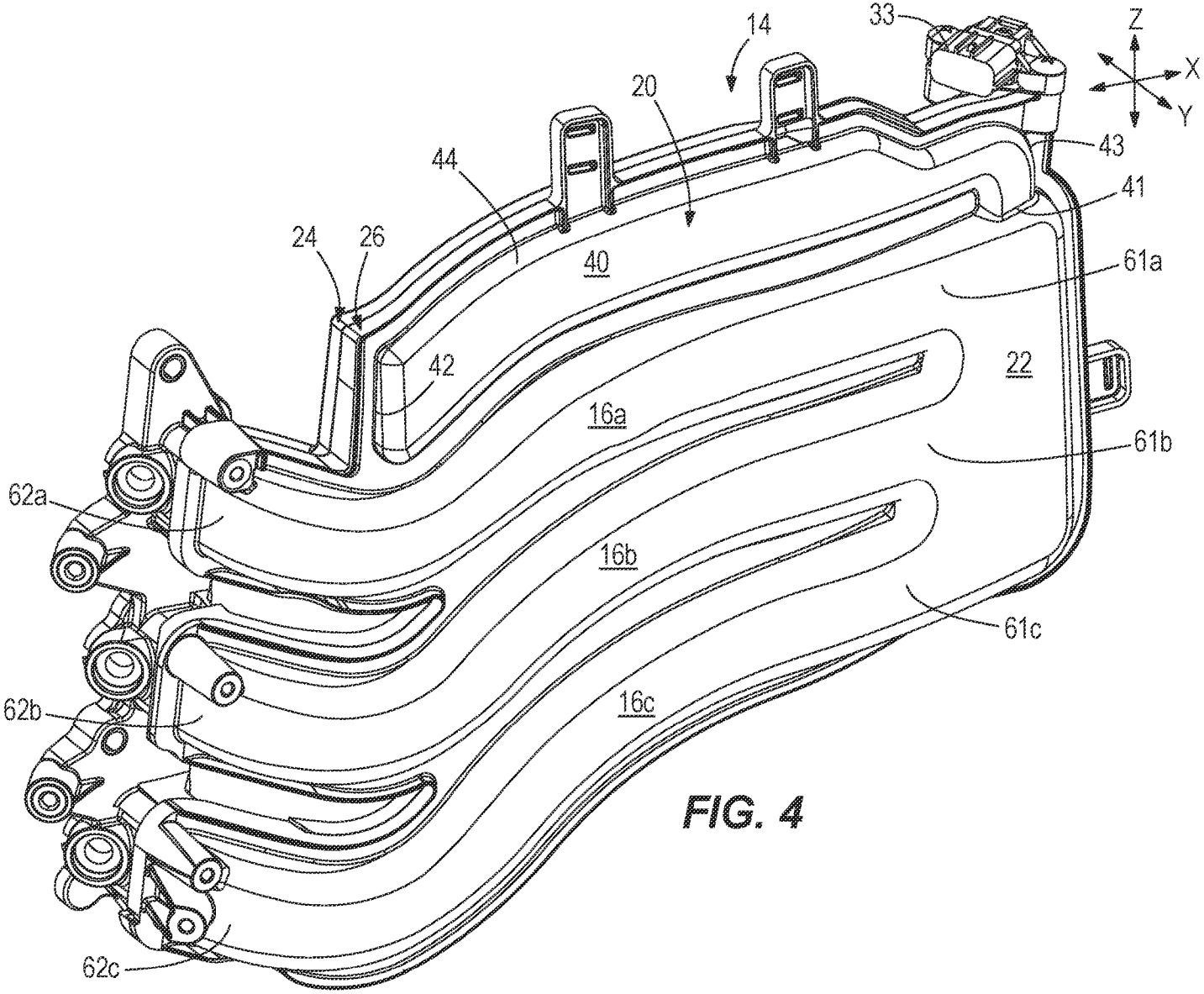
FIG. 4 is a side perspective view of the intake manifold.

Referring to FIGS. 3 and 4, the intake manifold 14 generally includes a plenum 22 for receiving the intake air from the throttle 30, three intake runners 16, and a novel quarter wave resonator 20. The plenum 22 is coupled to the throttle 30 and fluidically exposed to the quarter-wave resonator 20 and to each of the plurality of intake runners 16. As further described below, the intake manifold 14 is configured to convey the intake air from the throttle 30 to the engine 12 via the plenum 22 and the plurality of intake runners 16, as well as attenuate sound emanating from the engine 12 via the quarter-wave resonator 20.

Figure 7:
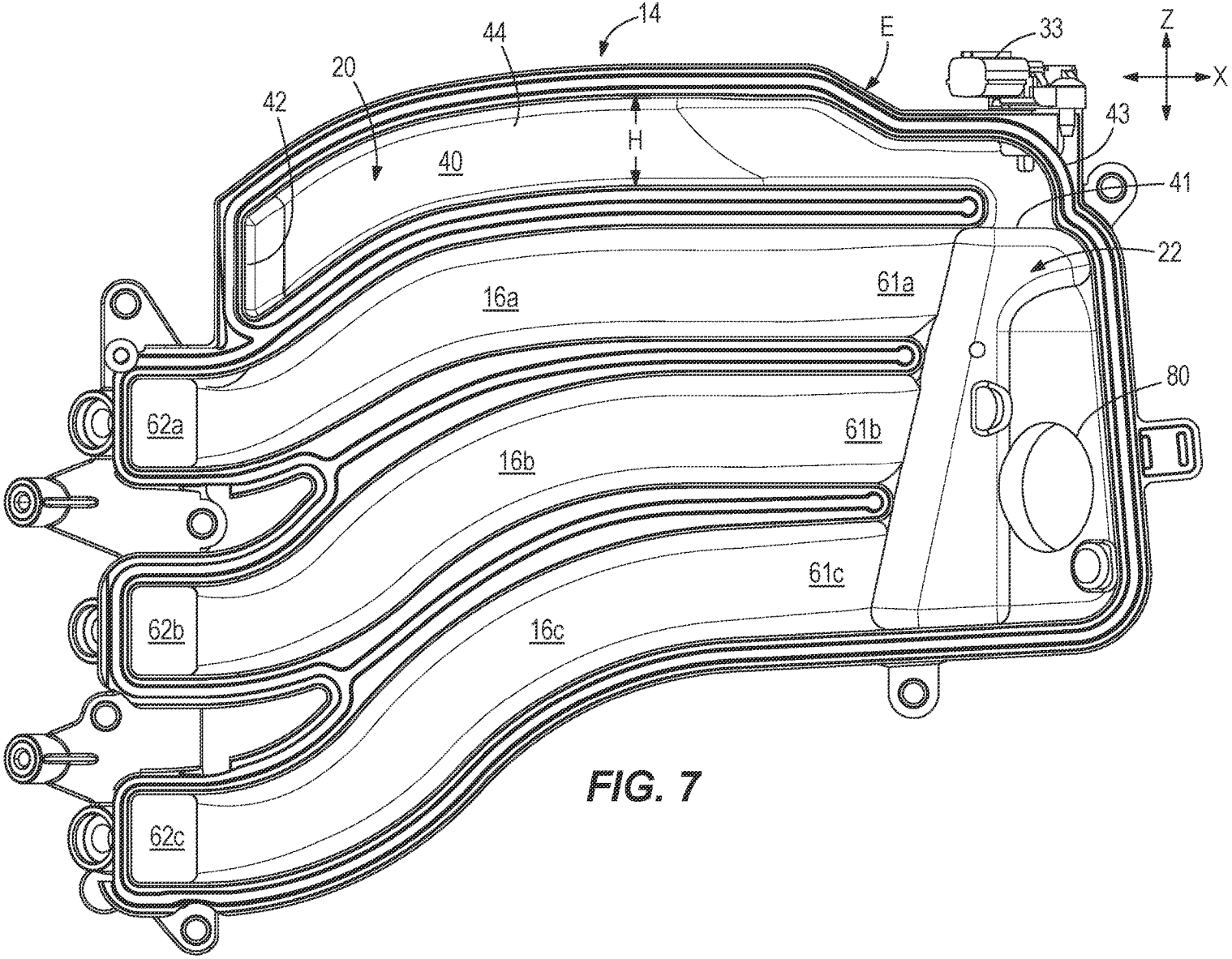
FIG. 7 is a side view of the inner manifold half.

In the illustrated example, the quarter-wave resonator 20 has an elongated cavity 40 which extends longitudinally from an open end 41 coupled to the plenum 22 to a closed end 42. The open end 41 is fluidically exposed to the plenum 22 and each of the intake runners 16. The elongated cavity 40 is defined by an elongated body 44 extending parallel to and adjacent the plurality of intake runners 16 and an elbow 43 coupling the elongated body 44 to the plenum 22. Each of the plurality of intake runners 16*a*, 16*b*, 16*c* extend longitudinally from an upstream end 61*a*, 61*b*, 61*c* exposed to the plenum 22 to a downstream end 62*a*, 62*b*, 62*c* exposed to a respective cylinder 13*a*, 13*b*, 13*c*. The intake runners 16*a*, 16*b*, 16*c* are vertically stacked and longitudinally extend parallel to one another. The upstream ends 61*a*, 61*b*, 61*c* define a stepped formation, which vertically and longitudinally steps away from the open end 41 of the quarter-wave resonator 20, relative to the plenum 22, as is best shown in FIG. 7. The stepped formation permits each of the runners 16 to be generally equal in length for volumetric efficiency and maintain exposure of the upstream ends 61*a*, 61*b*, 61*c* to the open end 41 of the quarter-wave resonator 40. In the illustrated example, the quarter-wave resonator 20 is located on top of the stacked runners 16, however this configuration is non-limiting, so long as the open end 41 is fluidically exposed to the plenum 22. The number and configuration of cylinders 13 and runners 16 can vary from what is herein shown and described, as can the location of the quarter-wave resonator 20.

Figure 6:
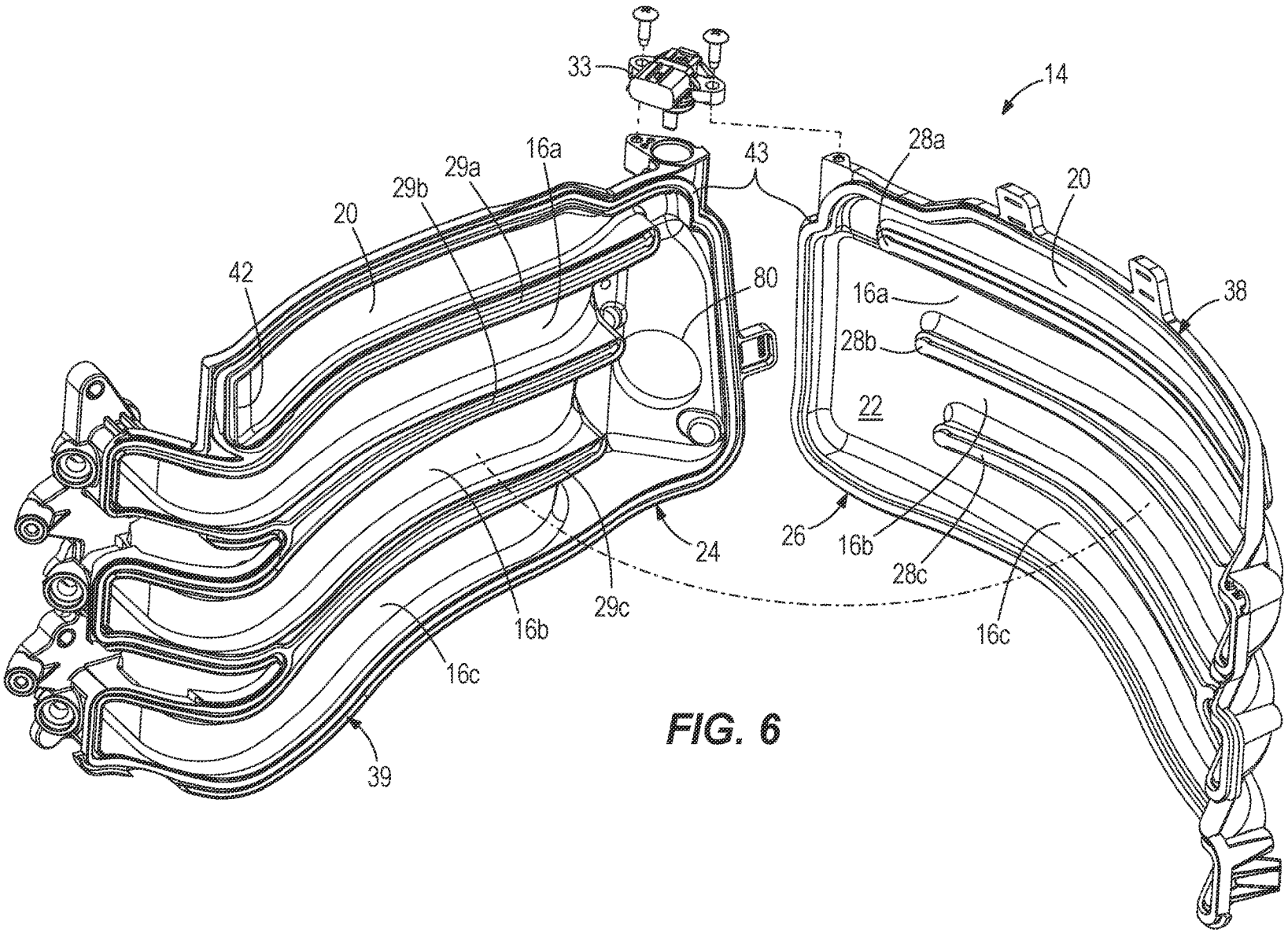
FIG. 6 is an exploded view of the intake manifold, showing the inner manifold half exploded from the outer manifold half.

The intake manifold 14 further includes a Temperature Manifold Absolute Pressure (TMAP) Sensor 33, which is coupled to the elbow 43 and exposed to the plenum 22 via the open end 41 of the elongated cavity 40, as shown in FIGS. 6-7. The sensor 33 is configured to sense temperature and pressure of the intake manifold 14 via exposure to the intake air which is conveyed to the cylinders 13 via the throttle 30. To spatially accommodate the TMAP Sensor 33, the vertically uppermost edge of the elongated body 44 slopes downward at E, as is shown in FIG. 7, before rounding along the elbow 43.

Referring to FIG. 6, the intake manifold 14 has a monolithic inner manifold half 24 and a monolithic outer manifold half 26 which are mated together to define the intake runners 16, the plenum 22, and the quarter wave resonator 20. In a non-limiting example, the monolithic inner manifold half 24 and monolithic outer manifold half 26 are molded components. Advantageously, by forming the halves 24, 26 as monolithic, the resultant manifold 14 has improved strength and resistance to failures during engine backfiring, thus helping to prevent engine runaway. The monolithic inner manifold half 24 and monolithic outer manifold half 26 may be mated together in a variety of ways. In the illustrated example, elongated ribs 28*a*, 28*b*, 28*c* extend between adjacent intake runners 16 and the quarter-wave resonator 20 on the monolithic outer manifold half 26, and are mated with corresponding elongated channels 29*a*, 29*b*, 29*c* extending between adjacent intake runners 16 and the quarter-wave resonator 20 on the monolithic inner manifold half 24. The ribs and channels 28, 29 define the outer walls of each of the intake runners 16 and separate the runners 16 and the quarter-wave resonator 20. An outermost edge of the monolithic inner and outer manifold halves 24, 26 have female and male mating edges 39, 38 respectively, peripherally extending around the intake manifold 14. Other non-limiting examples of mating options include welding, bolts, screws and/or the like.

Figure 5:
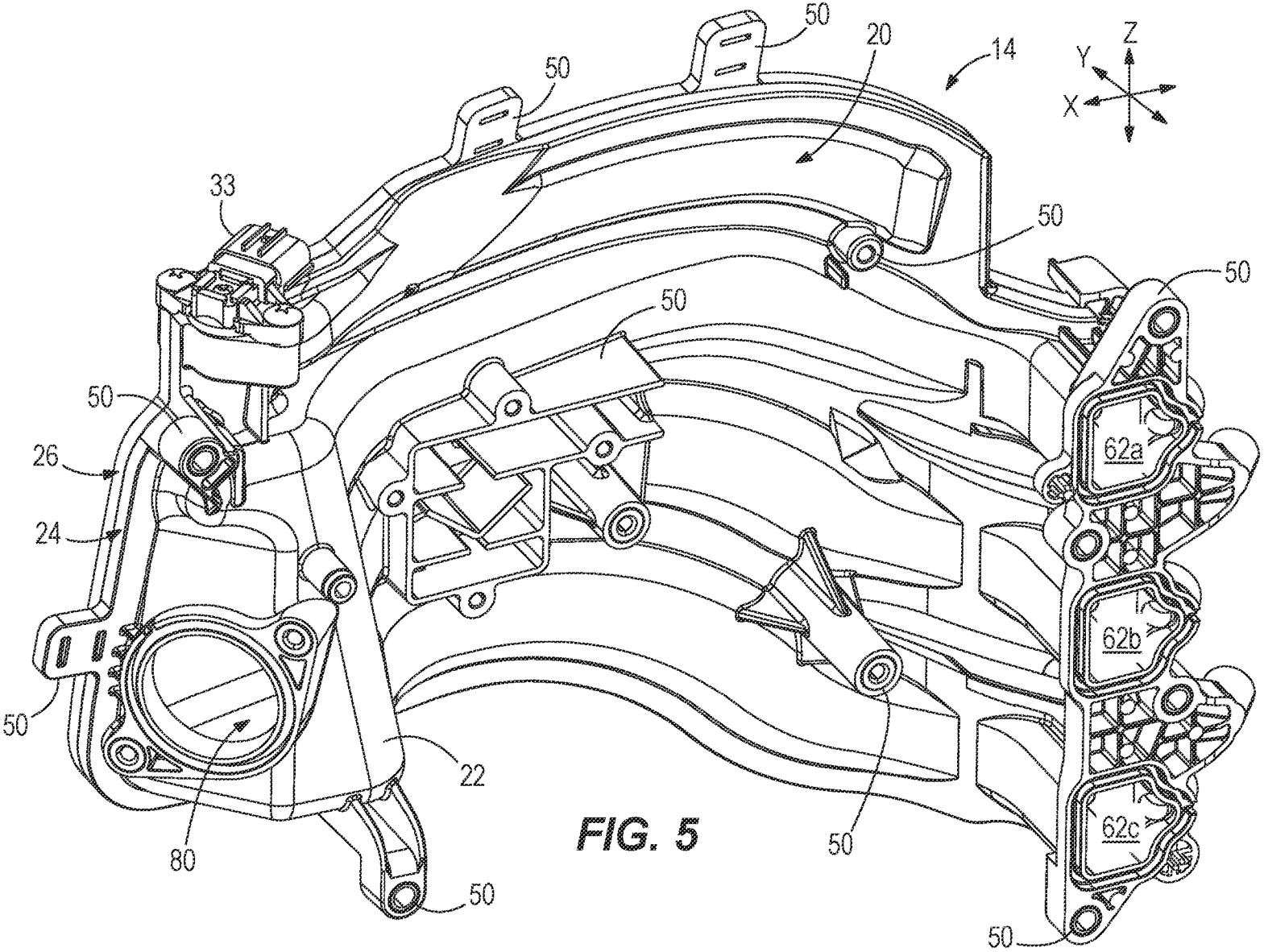
FIG. 5 is an opposite side perspective view of the intake manifold.

FIGS. 4-5 and 8-9 illustrate the intake manifold 14 wherein the monolithic inner manifold half 24 and monolithic outer manifold half 26 are mated together. As best shown in FIG. 5, each of the monolithic inner and outer manifold halves 24, 26 include various mounting features 50 formed integrally for coupling to the engine 12. Non-limiting examples of mounting bosses and/or strengthening ribs 50 for securely fastening the intake manifold 14 to the engine 12 via for example screws, bolts, friction fit, and/or the like. As shown in FIGS. 5-7, an air inlet 80 is formed integrally within the inner monolithic manifold half 24 which is configured to receive the intake air from the throttle 30.

Figure 8:
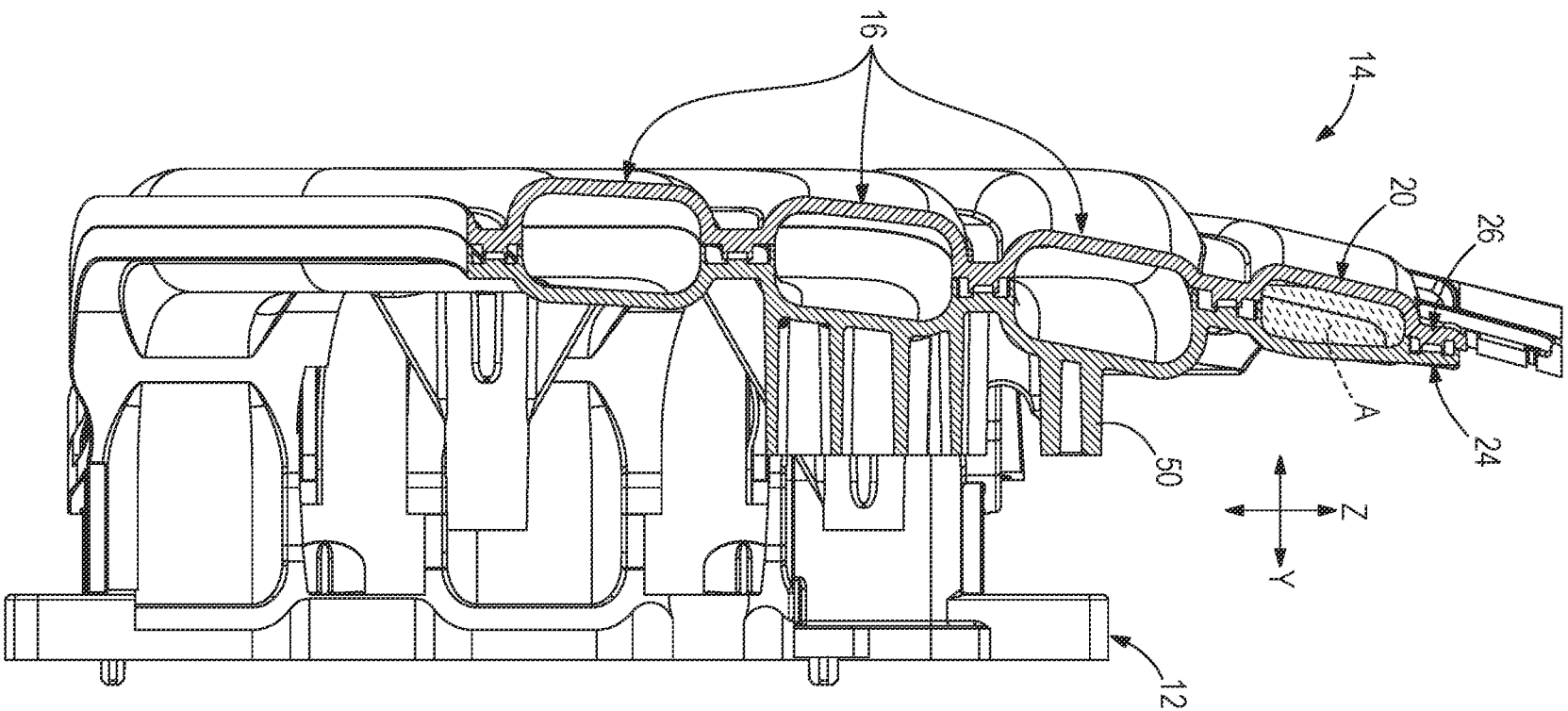
FIG. 8 is a view of Section 8-8, taken in FIG. 3.
Figure 9:
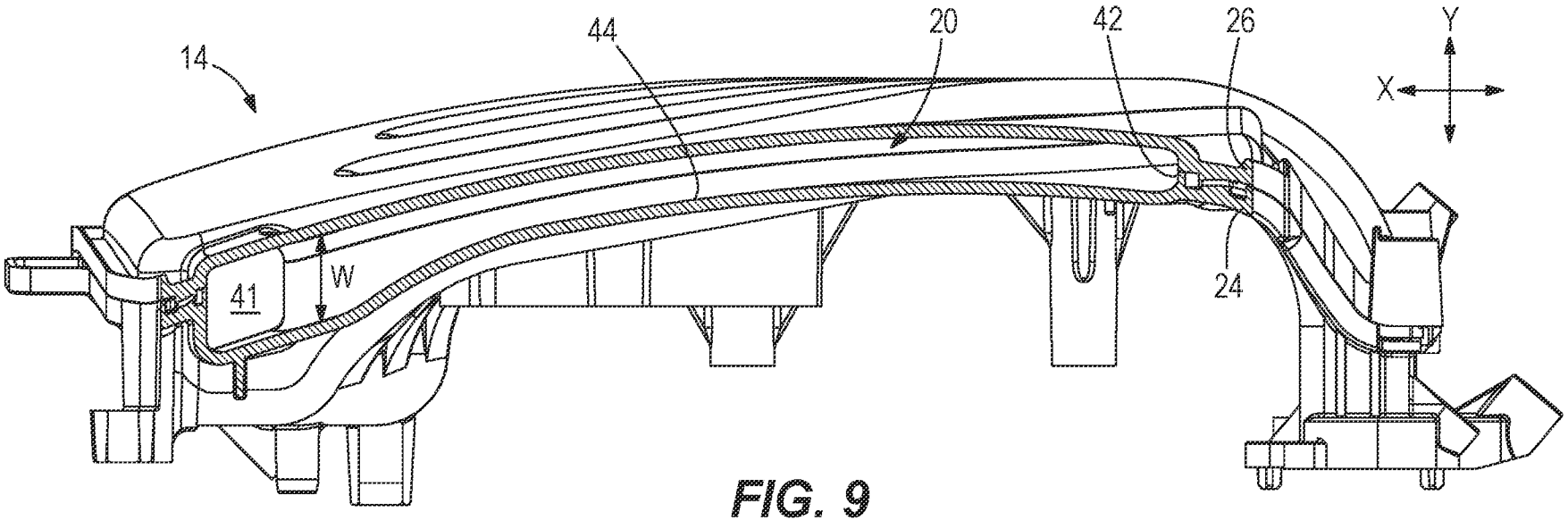
FIG. 9 is a view of Section 9-9, taken in FIG. 3.

Referring to FIGS. 7-9, cross-sectional area A of the elongated cavity 40 is given by a height H and a width W along the elongated cavity 40. FIG. 7 illustrates the height H of the cross-sectional area A along the X axis. FIG. 9 illustrates the width W of the cross-sectional area A along the X axis. The resonator 20 of the present disclosure is configured so that the cross-sectional area A is consistent along an entire length of the elongated cavity 40 in the longitudinal direction X. The length of the elongated cavity 40 is considered to be the distance from the closed end 42 to the open end 41. As shown in FIGS. 7-9, as the height H decreases at E to accommodate the TMAP sensor 33, the width W increases to provide a consistent area A.

The cross sectional area A and length of the elongated cavity 40 are tuned (i.e., sized and shaped) to attenuate a predetermined frequency of sound emitted from the engine 12 via the intake runners 16. The quarter wave resonator 20 illustrated herein has one open end 41 and one closed end 42. The length of the elongated cavity 40 determines at what point the sound wave is reflected upon itself. The quarter-wave resonator 20 is tuned so that the sound wave is reflected one hundred and eighty degrees out of phase with itself. This is achieved by making the length of the elongated cavity 40 one quarter of the wavelength of the frequency of sound waves entering the quarter-wave resonator 20 such that when the wave has traveled a distance down and back through the resonator 20, it will have traveled one half of the wavelength of the frequency to be attenuated. Such a configuration allows for sound waves to enter the open end 41, oscillate along the elongated body 44, reflect off the closed end 42, oscillate back along the elongated body, and arrive back at the open end 41 one hundred and eighty degrees out of phase with the oncoming waves so that the sound waves destructively interfere and attenuate the sound emitted from the engine 12. The intake manifold 14 of the present disclosure is advantageously tuned to attenuate third-order frequencies, which is the prominent firing frequency for a three-cylinder engine, but this configuration is not limiting.

In other examples, the quarter-wave resonator could be tuned to accommodate a variety of number of cylinders and firing frequencies.

In operation, cylinders 13*a*, 13*b*, and 13*c* of the engine 12 require intake air to initiate a combustion reaction for powering a propulsion apparatus. As conventional, pistons within the cylinders 13 are pulled downward during an intake stroke, which in turn creates a vacuum within the respective cylinder 13 that initiates the throttle 30 to dispense a controlled amount of intake air into the intake manifold 14 via the air inlet 80. The intake air is received within the plenum 22 and flows from the upstream ends 61*a*, 61*b*, 61*c* of the intake runners 16*a*, 16*b*, 16*c* to the downstream ends 62*a*, 62*b*, 62*c*, wherein it is discharged into the cylinders 13*a*, 13*b*, 13*c*, respectively. During the combustion reaction, the pistons are then pushed upwards, whereupon fuel is mixed with the intake air and ignited to produce the energy which drives the propulsion apparatus. This reaction produces sound waves which are emitted through the intake manifold 14. As the sound waves travel upstream from the cylinders 13, out of the upstream ends 61, exposure to the open end 41 of the quarter-wave resonator 20 allows said sound waves to pass into the open end 41, through the elongated cavity 40, and out again through the open end 41, where destructive interference attenuates the overall sound production.

Figure 10:
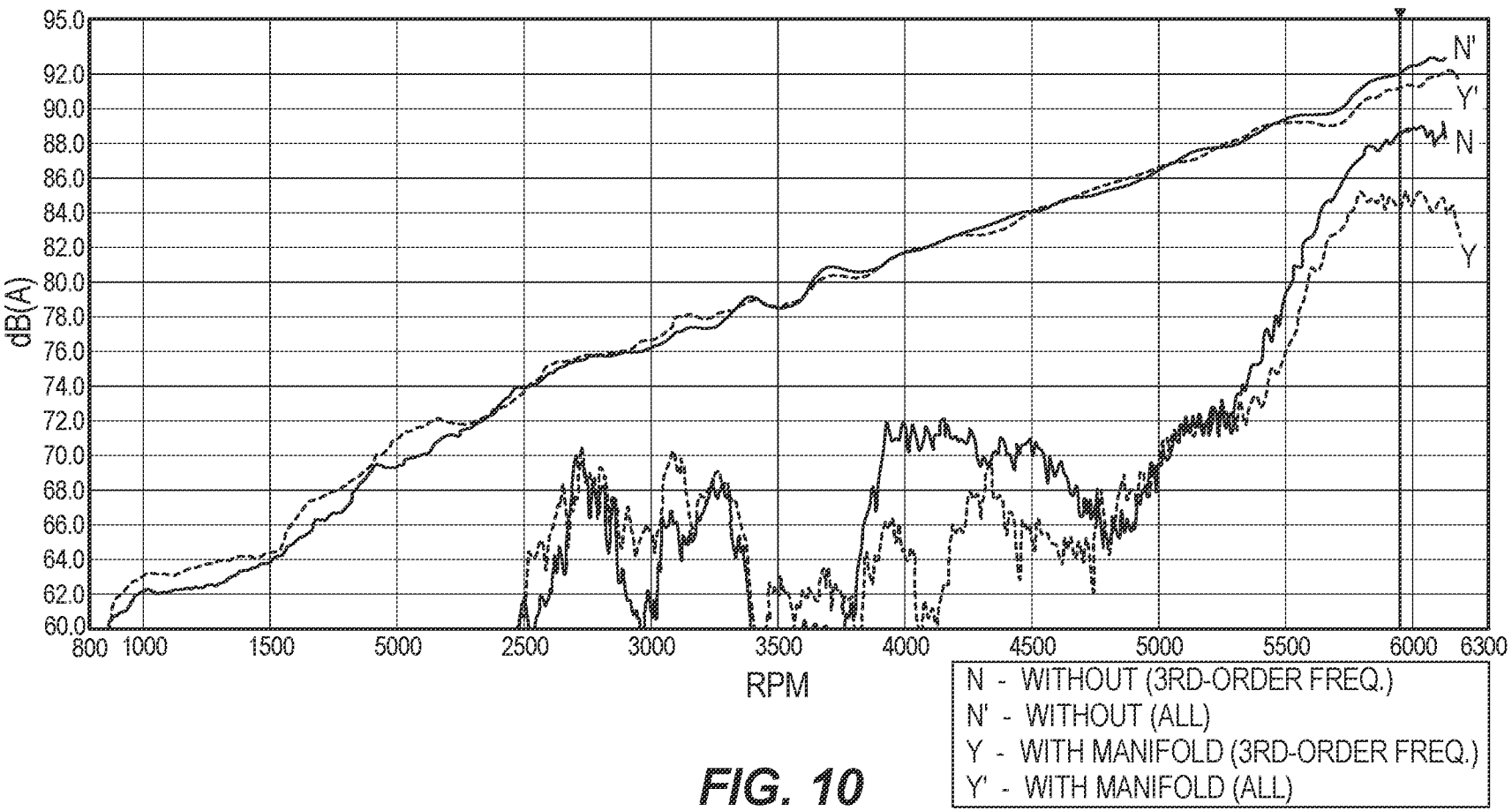
FIG. 10 is a graph illustrating change in noise (dB) emanating from the marine drive at various speeds (RPM).

FIG. 10 is a graph illustrating performance improvements accomplished by the presently disclosed intake manifold 14, compared to operation of the engine 12 without it. Both dashed lines Y and Y' represent the engine 12 with the intake manifold 14, and both solid lines N and N' represent the engine 12 without it. Lines Y' and N' illustrate reduced decibels of overall sound production when the intake manifold 14 was used at 5950 RPM. Lines Y and N illustrate reduced decibels for third-order firing frequencies when the intake manifold was used at 5950 RPM, the most prominent firing frequency in a three-cylinder engine.

This written description uses examples to disclose the invention, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An intake manifold for a marine engine having a throttle for controlling flow of intake air to the marine engine, the intake manifold comprising:

a plenum for receiving the intake air from the throttle, a plurality of intake runners which extends from upstream ends receiving the intake air from the plenum to downstream ends for discharging the intake air to the marine engine, and a quarter wave resonator having an elongated cavity extending from an open end coupled to the plenum to a closed end, the elongated cavity being tuned to attenuate sound emanating from the marine engine via the plurality of intake runners, wherein the upstream ends of the plurality of intake runners has a stepped formation relative to the plenum.

2. The intake manifold according to claim 1, wherein the quarter wave resonator extends parallel to the plurality of intake runners.

3. The intake manifold according to claim 1, wherein the quarter wave resonator extends adjacent to the plurality of intake runners.

4. The intake manifold according to claim 1, wherein the plurality of intake runners are aligned in a stack and wherein the quarter wave resonator is on top of aligned with the stack.

5. The intake manifold according to claim 1, wherein the open end of the quarter wave resonator is exposed to the plenum and also exposed to the upstream ends of the intake plenum.

6. The intake manifold according to claim 1, wherein the stepped formation steps away from the open end of the quarter wave resonator.

7. The intake manifold according to claim 1, wherein each intake runner in the plurality of intake runners are equal in length.

8. An intake manifold for a marine engine having a throttle for controlling flow of intake air to the marine engine, the intake manifold comprising:

a plenum for receiving the intake air from the throttle, a plurality of intake runners which extends from upstream ends receiving the intake air from the plenum to downstream ends for discharging the intake air to the marine engine, and a quarter wave resonator having an elongated cavity extending from an open end coupled to the plenum to a closed end, the elongated cavity being tuned to attenuate sound emanating from the marine engine via the plurality of intake runners, wherein the intake manifold comprises a monolithic inner manifold half and a monolithic outer manifold half which are mated together to define the plurality of intake runners, the plenum, and the quarter wave resonator.

9. The intake manifold according to claim 1, wherein the quarter wave resonator comprises an elongated body extending alongside the plurality of intake runners and an elbow portion which couples the elongated body to the plenum.

10. An intake manifold for a marine engine having a throttle for controlling flow of intake air to the marine engine, the intake manifold comprising:

a plenum for receiving the intake air from the throttle, a plurality of intake runners which extends from upstream ends receiving the intake air from the plenum to downstream ends for discharging the intake air to the marine engine, a quarter wave resonator having an elongated cavity extending from an open end coupled to the plenum to a closed end, the elongated cavity being tuned to attenuate sound emanating from the marine engine via the plurality of intake runners, wherein the quarter wave resonator comprises an elongated body extending alongside the plurality of intake runners and an elbow portion which couples the elongated body to the plenum, and a sensor coupled to the elbow portion and exposed to the plenum via the open end of the elongated cavity, the sensor being configured to sense temperature and pressure of the intake manifold.

11. An intake manifold for a marine engine having a throttle for controlling flow of intake air to the marine engine, wherein the intake manifold extends in a length direction, a width direction which is perpendicular to the length direction, and a height direction that is perpendicular to the length direction and perpendicular to the width direction, the intake manifold comprising:

a plurality of intake runners which are aligned in a stack relative to the height direction and longitudinally extends from upstream ends for receiving the intake air to downstream ends for discharging the intake air to the marine engine, a plenum for receiving the intake air from the throttle and discharging the intake air to the upstream ends of the plurality of intake runners, and a quarter wave resonator extending from an open end coupled to the plenum to a closed end, the quarter wave resonator being located on one side of the stack relative to the height direction and having a tuned elongated cavity configured to attenuate sound emanating from the marine engine via the plurality of intake runners.

12. The intake manifold according to claim 11, wherein the intake manifold comprises a monolithic inner manifold half and a monolithic outer manifold half which are mated together in the width direction to define therebetween the plurality of intake runners, the plenum, and the quarter wave resonator.

13. A marine engine comprising:

an engine block having a plurality of cylinders for combustion, wherein the engine block extends in a length direction, in a width direction which is perpendicular to the length direction, and in a height direction that is perpendicular to the length direction and perpendicular to the width direction, a throttle for controlling flow of intake air to the engine block, an intake manifold, the intake manifold comprising a plenum for receiving the intake air from the throttle and a plurality of intake runners which are aligned in a stack relative to the height direction and longitudinally extends from upstream ends receiving the intake air from the plenum to downstream ends discharging the intake air to the plurality of cylinders, and a quarter wave resonator extending from an open end coupled to the plenum to a closed end, the quarter wave resonator being located on one side of the stack relative to height direction and having an elongated cavity which is tuned to attenuate sound emanating from the marine engine via the plurality of intake runners.

14. The marine engine according to claim 13, wherein the quarter wave resonator extends parallel to the plurality of intake runners.

15. The marine engine according to claim 13, wherein the quarter wave resonator is above the stack relative to the height direction.

16. The marine engine according to claim 13, wherein the open end of the quarter wave resonator is exposed to the plenum and also exposed to the upstream ends of the intake plenum.

17. A marine engine comprising:

an engine block having a plurality of cylinders for combustion, wherein the engine block extends in a length direction, in a width direction which is perpendicular to the length direction, and in a height direction that is perpendicular to the length direction and perpendicular to the width direction, a throttle for controlling flow of intake air to the engine block, an intake manifold, the intake manifold comprising a plenum for receiving the intake air from the throttle and a plurality of intake runners which longitudinally extends from upstream ends receiving the intake air from the plenum to downstream ends discharging the intake air to the plurality of cylinders, and a quarter wave resonator extending from an open end coupled to the plenum to a closed end, the quarter wave resonator longitudinally extending alongside the plurality of intake runners and having an elongated cavity which is tuned to attenuate sound emanating from the marine engine via the plurality of intake runners, wherein the upstream ends of the plurality of intake runners has a stepped formation relative to the plenum.

18. The marine engine according to claim 13, wherein the quarter wave resonator comprises an elongated body extending alongside the plurality of intake runners and an elbow portion which couples the elongated body to the plenum.

19. A marine engine comprising:

an engine block having a plurality of cylinders for combustion, wherein the engine block extends in a length direction, in a width direction which is perpendicular to the length direction, and in a height direction that is perpendicular to the length direction and perpendicular to the width direction, a throttle for controlling flow of intake air to the engine block, an intake manifold, the intake manifold comprising a plenum for receiving the intake air from the throttle and a plurality of intake runners which longitudinally extends from upstream ends receiving the intake air from the plenum to downstream ends discharging the intake air to the plurality of cylinders, a quarter wave resonator extending from an open end coupled to the plenum to a closed end, the quarter wave resonator longitudinally extending alongside the plurality of intake runners and having an elongated cavity which is tuned to attenuate sound emanating from the marine engine via the plurality of intake runners, wherein the quarter wave resonator comprises an elongated body extending alongside the plurality of intake runners and an elbow portion which couples the elongated body to the plenum, and further comprising a sensor coupled to the elbow portion and exposed to the plenum via the open end of the elongated cavity, the sensor being configured to sense temperature and pressure of the intake manifold.

20. The intake manifold according to claim 8, wherein the monolithic inner manifold half and monolithic outer manifold half are molded components.

21. The intake manifold according to claim 11, wherein the quarter wave resonator is located above and extends parallel to the plurality of intake runners.

22. The intake manifold according to claim 11, wherein the tuned elongated cavity has a consistent cross-sectional area along an entire length of the tuned elongated cavity in the length direction.

23. The intake manifold according to claim 22, wherein the length of the tuned elongated cavity extends from the open end to the closed end.

24. The intake manifold according to claim 23, wherein the tuned elongated cavity has a height and a width which increase or decrease relative to each other along the length of the tuned elongated cavity to maintain the consistent cross-sectional area.

25. The marine engine according to claim 13, wherein the quarter wave resonator extends parallel to the plurality of intake runners.

26. The marine engine according to claim 13, wherein the elongated cavity has a consistent cross-sectional area along an entire length of the elongated cavity in the longitudinal direction.

27. The marine engine according to claim 26, wherein the length of the elongated cavity extends from the open end to the closed end.

28. The marine engine according to claim 27, wherein the elongated cavity has a height and a width which increase or decrease relative to each other along the length of the elongated cavity to maintain the consistent cross-sectional area.

29. A marine engine comprising:

an engine block having a plurality of cylinders for combustion, wherein the engine block extends in a length direction, in a width direction which is perpendicular to the length direction, and in a height direction that is perpendicular to the length direction and perpendicular to the width direction, a throttle for controlling flow of intake air to the engine block, an intake manifold, the intake manifold comprising a plenum for receiving the intake air from the throttle and a plurality of intake runners which longitudinally extends from upstream ends receiving the intake air from the plenum to downstream ends discharging the intake air to the plurality of cylinders, and a quarter wave resonator extending from an open end coupled to the plenum to a closed end, the quarter wave resonator longitudinally extending alongside the plurality of intake runners and having an elongated cavity which is tuned to attenuate sound emanating from the marine engine via the plurality of intake runners, wherein the intake manifold comprises a monolithic inner manifold half and a monolithic outer manifold half which are mated together to define the plurality of intake runners, the plenum, and the quarter wave resonator.

* * * * *